US005874114A

United States Patent [19]

Schröfele

[11] Patent Number: 5,874,114

[45] Date of Patent: Feb. 23, 1999

[54] PRESS FOR PRODUCING COMPACTS FROM POWDERY MATERIAL

[75] Inventor: Josef Schröfele, Penzberg, Germany

[73] Assignee: Dorst-Maschinen und Anlagenbau Otto Dorst und Dipl. Ing. Walter Schlegel GmbH & Co., Germany

[21] Appl. No.: 427,615

[22] Filed: Apr. 24, 1995

[30] Foreign Application Priority Data

Apr. 27, 1994 [DE] Germany ..... 44 14 771.6

[51] Int. Cl.[6] ..... B30B 11/02; B22F 3/03; B28B 3/08

[52] U.S. Cl. ..... 425/78; 425/352; 425/355; 425/415

[58] Field of Search ..... 425/78, 352, 355, 425/415, 416, 422

[56] References Cited

U.S. PATENT DOCUMENTS

| | | | |
|---|---|---|---|
| 303,502 | 8/1884 | Fales et al. | 425/355 |
| 951,579 | 3/1910 | Rigby . | |
| 2,449,515 | 9/1948 | Seelig | 419/66 |
| 2,970,485 | 2/1961 | Frank | 74/55 |
| 3,802,818 | 4/1974 | Watanabe et al. | 425/355 |
| 5,049,054 | 9/1991 | Schaidl et al. | 425/78 |

FOREIGN PATENT DOCUMENTS

| | | |
|---|---|---|
| 31047 | 5/1884 | Germany . |
| 158472 | 10/1902 | Germany . |
| 602572 | 8/1934 | Germany . |
| 1291200 | 3/1969 | Germany . |
| 2443837 | 4/1976 | Germany . |
| 3123454 A1 | 3/1982 | Germany . |
| 3242706 A1 | 7/1983 | Germany . |
| 3904617 A1 | 8/1990 | Germany . |
| 3906268 A1 | 8/1990 | Germany . |
| 9311517.2 | 8/1993 | Germany . |

*Primary Examiner*—James P. Mackey
*Attorney, Agent, or Firm*—Vanophem Meehan & Vanophem, P.C.

[57] ABSTRACT

A press for producing compacts from powdery material. The press has a die with a cavity that receives particles therein. A lower punch moves towards an upper punch to press the particles within the cavity. A cam disk moves the lower punch by way of a movable base-plate. Motion is transmitted through a sliding block to the base-plate and a cylinder having a piston causes movement of the die during at least a portion of the movement of the lower punch over its path of travel to the upper punch.

8 Claims, 5 Drawing Sheets

PRESS FOR PRODUCING COMPACTS FROM POWDERY MATERIAL

BACKGROUND OF THE INVENTION

This invention relates to a method for producing compacts from ceramic or metallic particles and a pressing tool embodying a lower punch, an upper punch and a die for compacting the ceramic or metallic particles.

When compacts are produced from ceramic or metallic powder in a pressing mold the density and density distribution of these compacts depend essentially on the force of pressure and the manner of compression. For compacting one usually employs pressing tools consisting of an upper punch, a lower punch and a die. Since not only the force for overcoming the friction between individual powder grains and their elastic and plastic deformation is necessary for compacting, but also a force for overcoming the friction of the powder on the die wall, an uneven density results in the compact along the height of the pressed powder column. The density is greatest below the pressure ram and smallest in the lower zone of the compact.

Fluctuations in density can be reduced if the pressing tool is formed so that a floating die is moved by the wall friction forces in the pressing direction. This causes the powder column to be compacted by the upper punch and simultaneously pushed against the lower punch and compacted approximately evenly from both sides. Since the die stroke in the pressing direction depends on the frictional conditions and is thus not clearly defined, the resulting density distribution is poorly reproducible. One distinguishes the push-out method from the pull-off method.

In the push-out method the die is mounted on springs and performs a relative motion in the pressing direction during pressing, due to the wall friction forces. When the upper punch returns, the die recoils to its starting position due to the spring force. The compact is thereby raised from the lower punch, so that undesirable splintering or surface flaking can occur on the compact. In the ejection position the compact can be removed.

In the pull-off method predominantly applied today, the die is moved downward in forced coupling with the upper punch during pressing. The relation between the motions of upper punch and die can be coordinated with regard to an even density distribution of the compact. In the discharge position the die is moved down for removal of the compact. The pull-off method largely avoids surface flaking.

A disadvantage of the pull-off method predominantly utilized today is the elaborate kinematics for the upper punch. It is first moved into the closed position and then urged into the pressing position, which means that the upper punch and its drive must be dimensioned accordingly with respect. to both the closing motion and the pressing. Moreover, an elaborate control system is required for the stroke into the closed position and the following pressing motion. The die control is also elaborate, since it must be coordinated with the pressing stroke of the upper punch. The die must thus be moved from the filling position into the pressing position, and held in the pressing position (die support). Moreover, after the upper punch is moved away the die must be moved downward and after the compact is ejected moved up again, which necessitates a complicated structure and complicated control.

Altogether the force-related design of the upper punch kinematics, including the power transmission from the main shaft and the elaborate control of the die, involve a corresponding space requirement as well as a complicated structure of the press itself.

The problem of the invention is to provide a method for producing compacts from powdery material as well as a press for eliminating the above mentioned disadvantages, in particular for realizing a pressing method having simple kinematics and control as well as a simply constructed press.

SUMMARY OF THE INVENTION

According to the present invention the pressing is not performed by the upper punch but by the lower punch, which compresses against the fixed upper punch moved into the closed position, and thus involves a total departure from the conventional principle of the push-out and pull-off methods. To attain even compacting and a reproducible density distribution it is further essential that the die is taken along over part of the pressing stroke of the lower punch for the purpose of recompacting, which can preferably be done in constrained fashion by a slaving device which moves up the die over a slight distance, e.g. up to 6 mm, at the end of the pressing stroke of the lower punch. In a further variant, sliding upper pressing can be realized by moving up the die in constrained fashion in coordination with the lower punch, the transmission ratio being adjustable. This permits definite and above all reproducible density conditions to be adjusted in the compact. The kinematics and control of the upper punch need now be focused solely on the closing motion, which substantially simplifies the kinematics and control of the upper punch because the upper punch structure need not be designed for pressing. It is advantageous with respect to the press if the kinematics of the upper punch is realized by a pair of toggle levers since the force of pressure can be essentially taken up in the extended position of the pair of toggle levers in the closed position.

The compact is ejected by moving up the lower punch beyond its pressing position, which requires no die motion. Altogether this results in a very simple structure of the die, which can be produced by simple turned parts, whereby the control of the die is also extremely simple.

This method also makes it possible for the output from the main shaft of the press to the upper punch to take place via a cam disk mechanism which offers the advantage over other mechanisms such as connecting rods that the movement pattern of the upper punch, which need only be moved into the closed position, can be designed as desired. For example, the closing motion of the upper punch, which requires little force due to the decoupling from the buildup of pressing force, can take place quickly, which cannot be adjusted accordingly via a connecting rod mechanism. Furthermore, the cam disk mechanism can be adjusted by a special gear so that the closing time of the upper punch coincides with the onset of compacting by the lower punch. The resulting free design of the closing motion saves time, which is then available for the filling operation. Also, the closed position of the upper punch is very advantageous for tools with additional planes, as in the production of stepped compacts. In this case certain rams which must be transported from the filling position to an intermediate position before the onset of compacting are also moved into the position of the stopping point of the upper punch, whereas in the pull-off method, in which the upper punch also moves into the pressing position, these tool parts must be stopped separately, requiring a separate mechanism including appropriate supports.

Due to the short paths for the ejecting and compacting motions a cam disk mechanism can likewise be used advantageously for the pressing stroke of the lower punch. This structure in conjunction with the simple structure and simple kinematics of the die also allows a favorable adjustment of the working height in presses with a pressing force range up to approximately 300. To compared to conventional presses, whose working height is sometimes up to 1700 mm, so that a corresponding platform must be provided in front for the operating personnel or the press sunk in a pit to obtain a reasonable working height. The simple kinematics for the die control results above all from the fact that the compacting and ejecting force comes from below, i.e. goes in the same direction.

Summing up, the conventionally necessary holding-down components for the die and the die support mechanisms can be omitted, and there is more space in the base housing for the sliding upper pressing. Furthermore, there are fewer moving masses, which shortens the trailing time. In terms of both the motion of the upper punch and the motion of the lower punch it is possible to use a cam disk mechanism, which allows for corresponding possibilities of design. For example, the closing motion of the upper punch can be performed more quickly so that there is more space and time for filling since the die stands still, in contrast to the pull-off method. The upper punch stroke need be focused solely on the closing motion and can thus be kept as small as absolutely necessary. Since no great forces are necessary here, one requires no accordingly dimensioned tie rods or eccentrics, as in conventional presses, and it is possible to use a cam disk mechanism in the bottom press area, which provides constructional advantages. One thus obtains, in conjunction with the simple die structure including the simplified control of the die and the lower punch, a low working height and sufficient space for a fast change system for adapter clampings. The use of cam disk mechanisms furthermore permits optimal upper punch and lower punch motion by corresponding adjustment for venting, pressing time, and slow relief. Due to lack of tie rods one can design the fitting space more freely and make it accessible on the side. The die support in case of sequential upper pressing is wear-free since there are no movable support systems. Since it is unnecessary to clear the die support between the pressing position and the onset of ejection, which takes a certain time, there is more filling time. Short paths of the die facilitate the mounting of filling apparatus, take-off devices, and calibration feeds. No holding-down components are necessary for the die to prevent it from swelling when the upper punch is moved away upward. For the lower punch there is an optimized pressing motion with cam disk/roll or with toggle lever.

Other objects, features, and advantages of the invention will be better understood from the following description of a preferred embodiment of the invention taken in conjunction with the drawings appended hereto.

DETAILED DESCRIPTION OF THE PREFERRED EMBODIMENT

Figure 1:
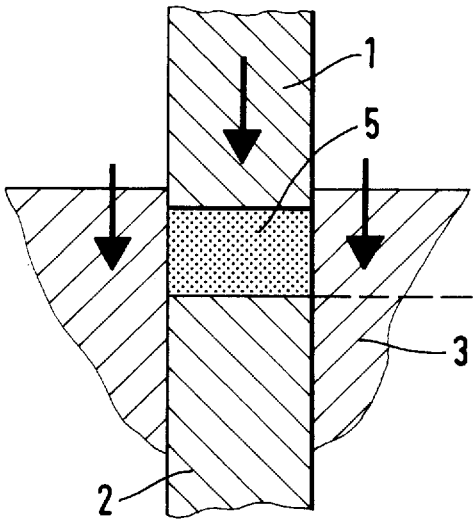
FIGS. 1 and 2 show schematic views of the pressing tool for explaining the conventional pull-off method.
Figure 2:
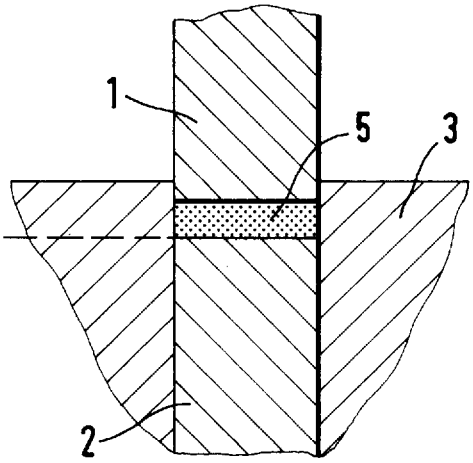

In FIGS. 1 to 4, 1 refers to an upper punch, 2 to a lower punch, 3 to a die, 4 to a compact, and 5 to a mold cavity. FIG. 1 shows for the pull-off method the pressing operation from the closed position of the press, whereby the upper punch 1 is moved toward the lower punch 2 with the lower punch 2 fixed, and the die 3 is thereby moved forcibly downward as well during the pressing operation. The pressing position is shown in FIG. 2. The compact 4 is ejected by moving the die 3 downward into the discharge position after moving the upper punch 1 away so that the compact 4 can be taken off the lower punch 2.

Figure 3:
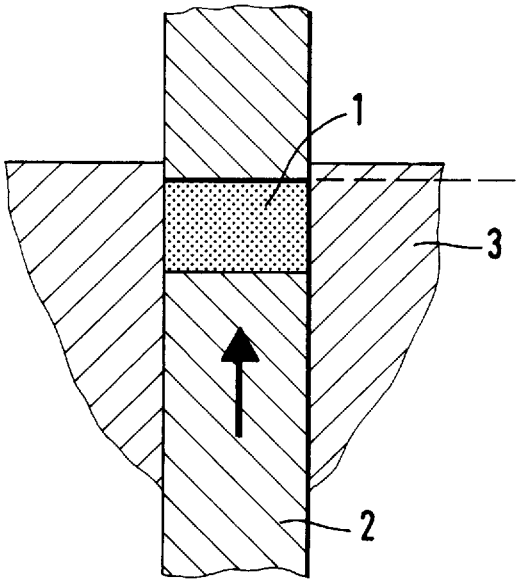
FIGS. 3 and 4 show schematic views for explaining the inventive pressing method.
Figure 4:
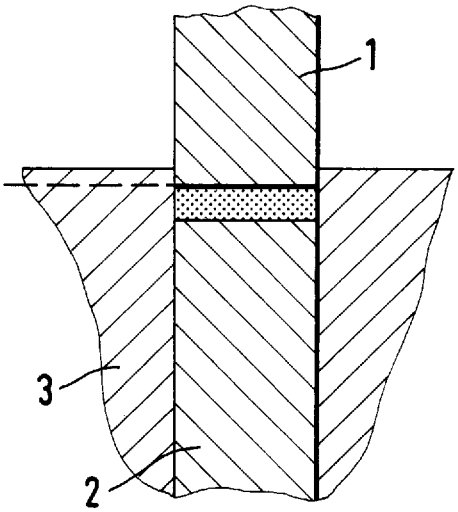

In the method of FIGS. 3 and 4 the upper punch 1 is moved into the closed position apparent from FIG. 3 after the mold cavity 5 is filled with powder. The pressing then takes place by the lower punch 2, which is moved upward toward the upper punch 1 into the pressing position apparent from FIG. 4. In the pressing method explained with reference to FIGS. 3 and 4, the die is fixed and the upper punch 1 is also fixed in its closed position apparent from FIG. 3 during the pressing operation.

If sliding upper pressing is to be realized at the same time for improving the density distribution, the die 3 can be moved upward with the lower punch 2 over a preset path at the end of the pressing stroke of the lower punch 2. In an alternative embodiment likewise described below, the die 3 is moved upward, relative to the fixed upper punch 1 located in the closed position, in synchronism with the lower punch 2 over a predetermined path at a preset speed coupled with the speed of the lower punch 2.

Figure 5A:
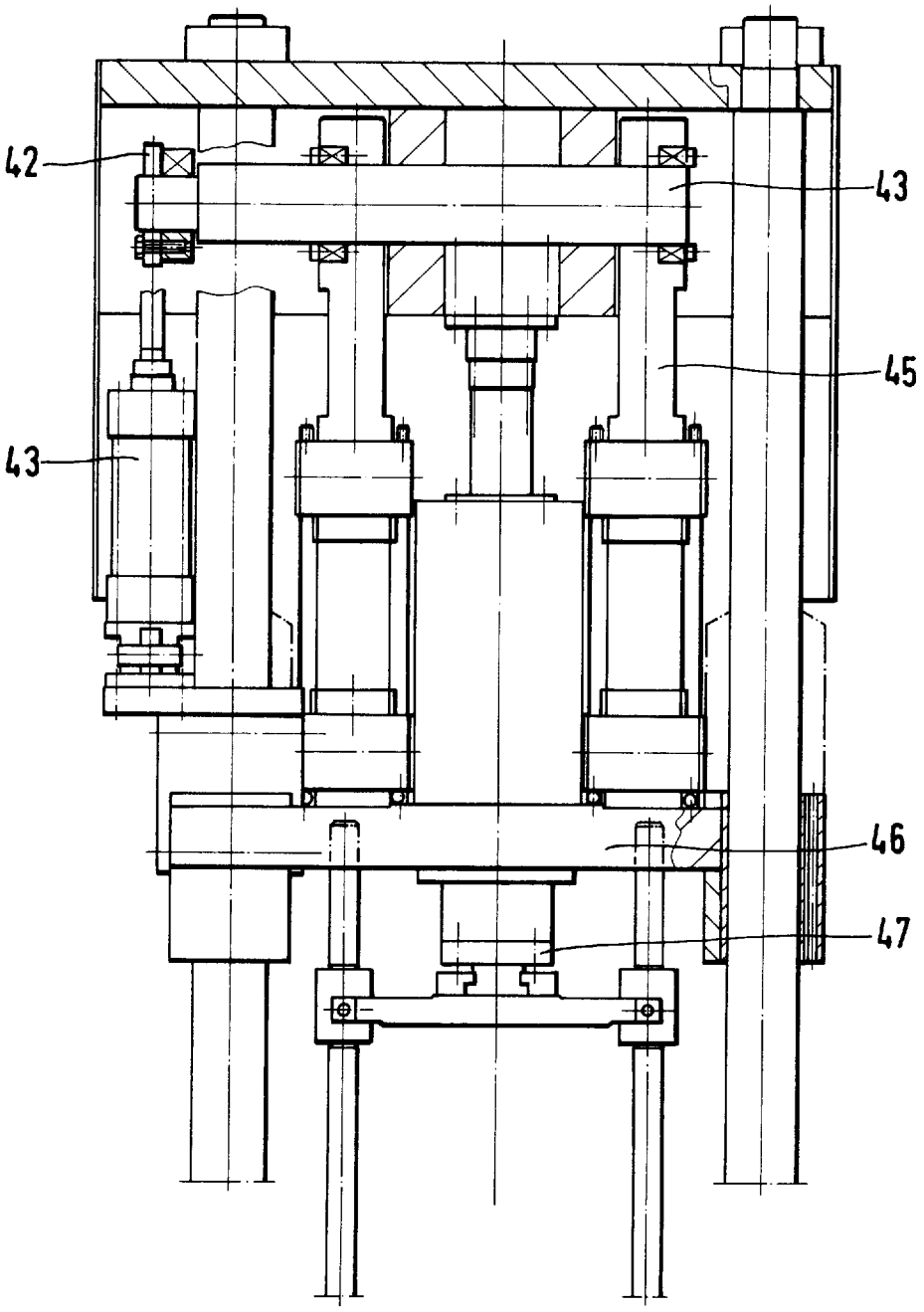
FIG. 5*a* shows a schematic view of the press structure at the crown.
Figure 5B:
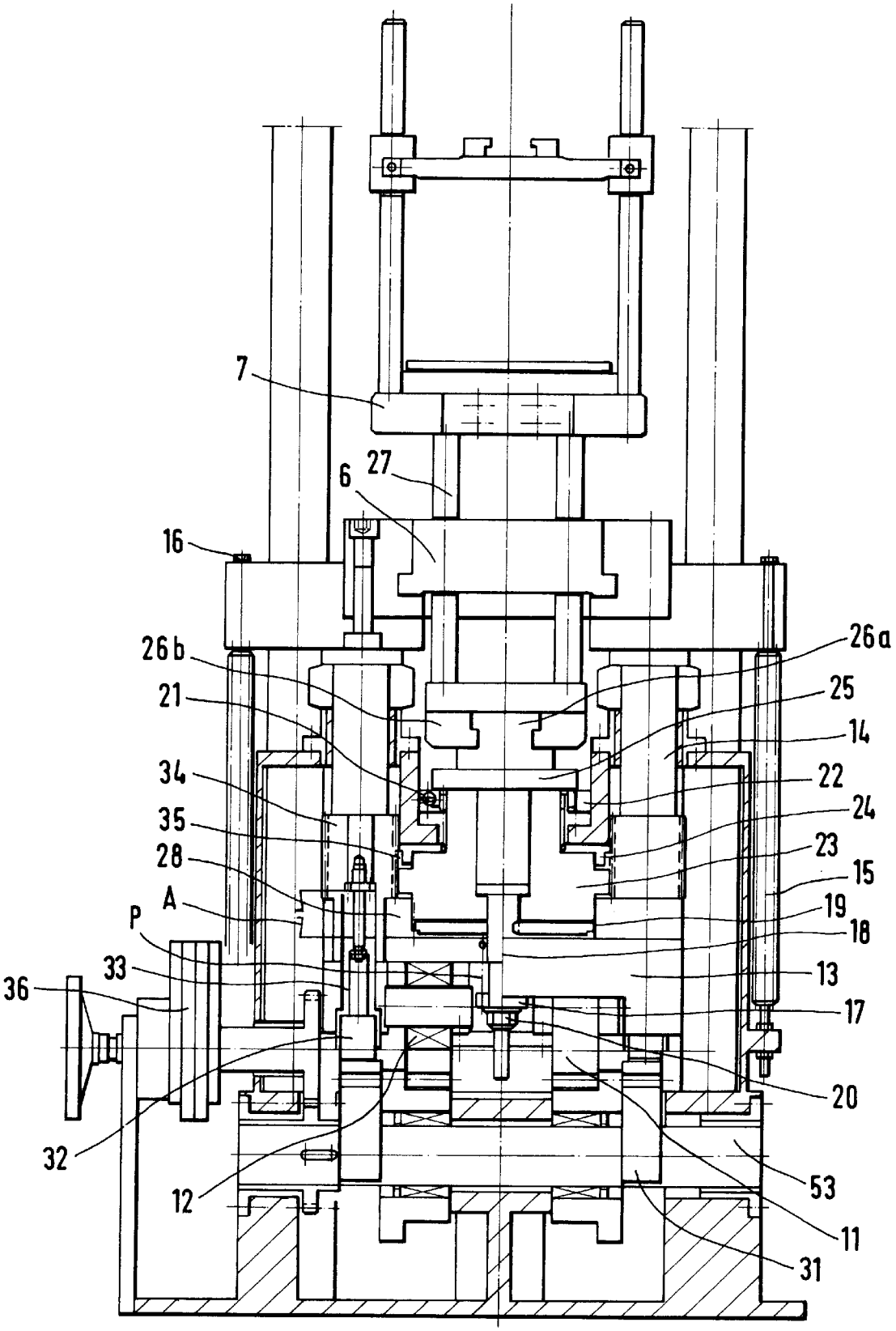
FIG. 5*b* shows a schematic view of the press structure at the bottom.

FIG. 5*b* shows the structure of the press in the bottom area, whereby 6 refers to a base-plate carrying the lower punch 2, 7 to a die, and 8 to a coupling part relative to which the die 7 is slidably guided via rods 9.

The stroke of the lower punch 2 carried by the base-plate 6 (not shown in FIG. 5*b*) from the filling position upward into the pressing position apparent from FIG. 5*b* takes place via a main shaft 53 driven by a drive (not shown) and a pair of cam disks 11 fastened thereto whose curve is picked up by rotatably mounted rollers 12 which act on the lower punch 2 via a traverse 13. The traverse 13 is coupled with rods 14 which are firmly connected with the base-plate 6. In FIG. 5*b*, which shows the pressing position, the traverse 13 is located at its highest point.

Since only an upward motion of the lower punch is possible via the cam disk 11, the lower punch is returned to the filling position via a spring system referred to as 15 which is a pair of opposing tension springs firmly coupled at their upper ends at 16 with the base-plate 6 and thus the lower punch 2. In lieu of a spring system one can also use any other suitable device, such as pneumatic or hydraulic restoring means, but the restoration can also be effected by the inherent weight of the base-plate 6 and the connected components.

The end stop for the filling position is determined by a stop ring 17 which is adjustable via a spindle 18 and a cooperating gearwheel 19, and fixed by a nut 20. The actual press stroke from the adjustable filling position formed by the stop ring 17 to the pressing position is marked as P in FIG. 5*b*.

As explained at the outset, the die can be fixed during pressing (according to FIG. 5*b*), the fixing being realized in the illustrated embodiment via a worm 21 operable from outside and cooperating with an associated threaded ring 22. In the illustrated embodiment the threaded ring 22 is turned upward so that the die is fixed. The pneumatic piston of the die referred to as 23 lies against a cylinder 24 so that no upward movement of the die is possible. Otherwise the die train is formed from the pneumatic piston 23 via a stop ring 25 and components 26*a* and 26*b*, and rods 27 penetrating the base-plate 6 and firmly connected with the die 7.

Alternatively, the die 7 can be released via the mechanism of the worm 21 and the threaded ring 22 for the purpose of recompacting from the top by moving the threaded ring 22 downward and thereby obtaining a predeterminable distance for the upward movement of the die 7 along with the lower punch 2 moving upward during pressing, so that the die 7 can be moved upward out of the filling position into the pressing position along with the lower punch 2. The filling position of the die 7 is located lower by the measure adjusted on the threaded ring 22. Since the die 7 is coupled with the lower punch 2 via the spindle 18 and the stop ring 17, the lower punch 2 is also located lower by the measure adjusted on the threaded ring 22, so that in the illustrated embodiment the movable distance adjustable via the threaded ring 22 is about 5 mm at the end of the upstroke of the lower punch 2. If the threaded ring 22 is turned downward one obtains a travel for the piston 23 relative to the cylinder 24 which is applied to the die 7. This causes the die 7 to be dragged, at the end of the motion of the lower punch 2, into the pressing position in which the piston 23 lies against the bottom of cylinder 24. The die 7 is taken along via two stop segments 28 which are disposed on the traverse 13. Grinding plates (not shown) on the stop segments 28 are used for exact adjustment relative to the pressing position. It thus turns out that no kinematic effort is necessary to move the die 7 for recompacting, in particular no separate drive, since it can be moved Via the traverse 13. This makes it possible to form the die 7 as a compact circular component requiring little space, so that the die elements can be formed by simple turned parts. A complicated die control can also be eliminated.

The ejection motion after the pressing operation takes place by moving the lower punch 2 up via the base-plate 6 out of the pressing position shown in FIG. 5b. For this purpose a pair of cam disks 31 are provided, being disposed on the main shaft 53. The cam disks 31 cooperate with sliding blocks 32, each received in a carrier 33. Each carrier 33 is; received in a hollow spindle element 34 which is adjustable via a pinion 35 for the purpose of adjusting the ejection path referred to as A in FIG. 5*b*. The adjustment by turning the hollow spindle 34 takes place via a thread with the carrier 33. The motion initiated via the cam disks 31 is transmitted via the rods 14 to the base-plate 6 so that the lower punch is moved upward out of the pressing position for the purpose of ejecting the compact. Of course other mechanisms can also be used in lieu of the sliding blocks 32, such as rollers.

Figure 6:
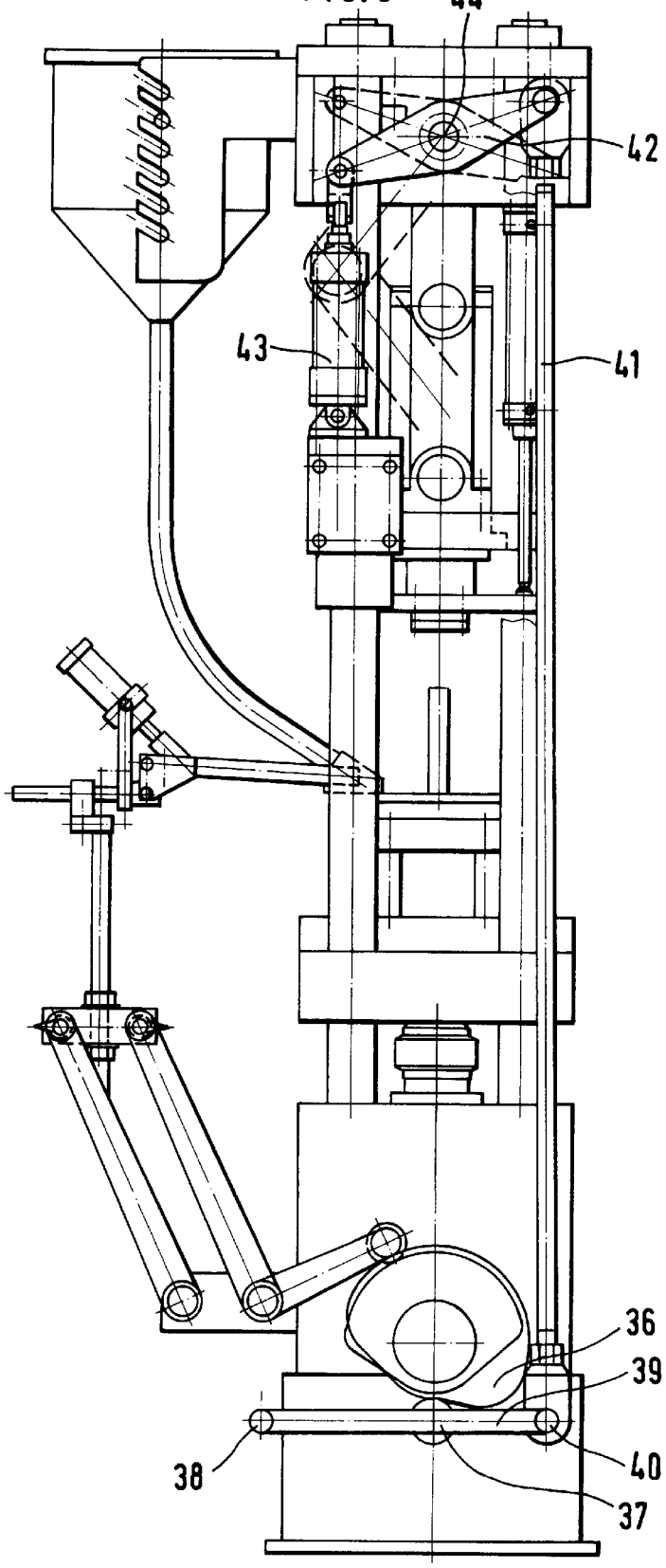
FIG. 6 shows a schematic view of parts of the press structure in a side view.

In the shown pressing method the upper punch need only effect a closing motion, not a pressing motion. The kinematics of the upper punch is explained best with reference to FIGS. 5*a* and 6.

Since the upper punch need only execute a closing motion, not a pressing motion, simple kinematics suffice since no great forces have to be transmitted. The output from the drive takes place via a cam disk 36 apparent from FIG. 5*a* which cooperates with one or more rollers 37, whereby the initiated motion takes place by a lever 39 mounted at 38 via a hinge point 40 to a tie rod 41 which is connected at its upper end with a double lever 42. At the other end of the double lever 42 there is a pneumatic or hydraulic cylinder 43 which executes the closing motion of the upper punch 1. The opening motion, i.e. the upward motion of the upper punch, takes place via the tie rod 41 and the cam disk and roller mechanism 36 and 37. For the purpose of closing the upper punch, the pneumatic cylinder 43 moves the double lever 42 which swivels a shaft referred to as 44, see also FIG. 5*a*. This moves a pair of toggle levers 45 fastened to the shaft 44, outward in particular putting them in the extended position (see FIG. 5*a*) in which the upper punch is located in the closed position. The pair of toggle levers 45 acts on a guide traverse 46 and on a coupling part 47 kinematically fixed therewith which serves to receive the upper punch 1, not shown in FIG. 5*a*. The upper punch 1 is adjustable relative to the guide traverse 46 via the coupling part 47 by means of a suitable adjusting unit not depicted in the illustrated embodiment example. Simple kinematics suffices for the motion of the upper punch 1 since no great forces need be transmitted due to the mere closing motion of the upper punch and in the pressing position the force of pressure can be readily taken up via the toggle levers in their extended position. Since no essential forces need be transmitted to the tie rod 41, a small rod can be used as the tie rod.

Figure 7:
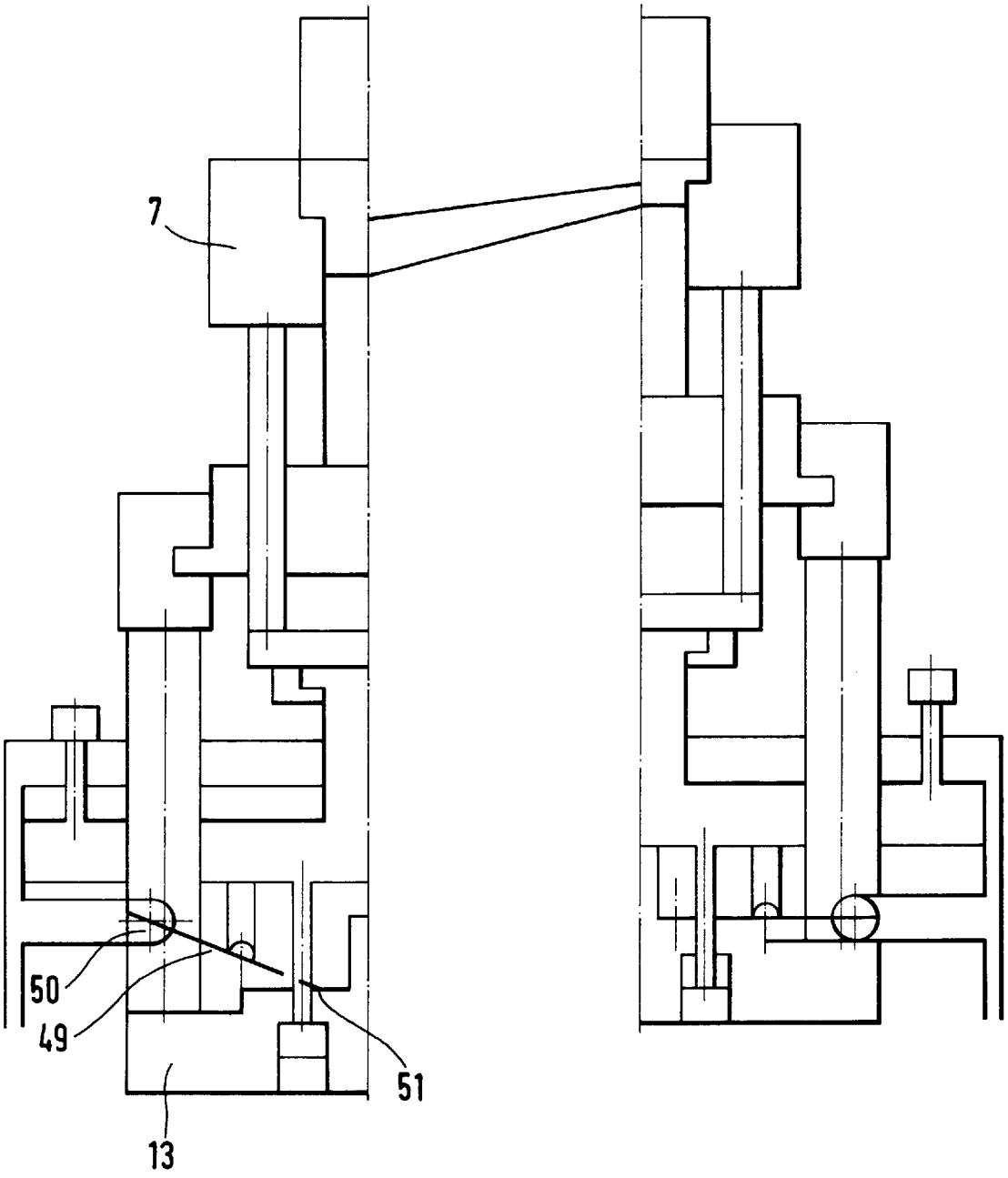
FIG. 7 shows a schematic view of the coupling of the die plate motion with the lower punch.

For the principle of upward sliding during pressing the die 7 can be moved upward along with the lower punch 2 at a coordinated speed and in a coordinated path, e.g. at half the speed of the lower punch over half the path of the lower punch, or at a quarter of the speed over a quarter of the path of the lower punch, which can be done with an apparatus that is best shown in FIG. 7.

For upward sliding during pressing a coupling of the die motion with the motion of the lower punch is provided, which takes place via a lever 49 mounted firmly in a bearing 50 relative to the machine housing. The other end of the lever 49 lies on the traverse 13 at 51 so that the lever 49 is swiveled with the motion of the lower punch via the traverse 13 around a point of the bearing or support 50. The swivel motion of the lever is transmitted via a sliding block 52 to the die 7, which determines the transmission ratio of the coupling of the die motion with the motion of the lower punch and/or guide traverse 13. When the guide traverse 13 is moved up, the lever 49 is swiveled upward so that the die 7 is moved via the sliding block 52 in synchronism with the motion of the lower punch, but with a corresponding transmission ratio. Upward sliding during pressing is advantageous above all when steps are present in the die. With sequential recompacting, i.e. pressing first from below and then from the top, the material would be pushed around the step after the first compacting process, which is a serious problem.

The particular advantage of this embodiment is that the die is positively moved upward. This counteracts the die forces which are produced by the pressing force component due to the steps in the die. A balance of forces comes about.

In the conventional pull-off method the die moves in the same direction as its pressing force component acts. This pressing force component must thus be taken up by additional devices in the press during the pressing operation.

While the invention has been described in terms of a preferred embodiment, it is apparent that other forms could be adopted by one skilled in the art. Accordingly, the scope of the invention is to be limited only by the following claims.

What is claimed is:

1. A press for producing an article from particles, said press comprising:

an upper punch;

a lower punch;

a die having a cavity therein for receiving particles;

means for moving said lower punch over a path of travel toward said upper punch to press the particles in said cavity of said die, said means for moving comprising: a rotatable shaft;

means for rotating said rotatable shaft;

a cam disk mounted on said rotatable shaft and rotatable therewith;

a movable base-plate, said lower punch being operatively associated with said base-plate and movable therewith; and means for converting rotation of said cam disk into movement of said base-plate;

a second cam disk mounted on said rotatable shaft and rotatable therewith;

means for converting rotation of said second cam disk into further movement of said lower punch to eject an article from said cavity of said die, said means for converting rotation comprising:

a hollow spindle;

a carrier received in said hollow spindle;

sliding block means received in said carrier, said sliding block means engaging in said second cam disk and being movable upon rotation of said second cam disk; and means for traversing said lower punch, said means for traversing transmitting motion of said sliding block means to said base-plate; and a cylinder having a piston, said piston being carried by said die and engaging said means for traversing to cause movement of said die during at least a portion of the movement of said lower punch over the path of travel.

2. A press according to claim 1 and further comprising:

means for moving said die toward said upper punch over a predetermined final portion of the path of travel of said lower punch.

3. A press according to claim 1 and further comprising:

means for moving said die toward said upper punch in synchronism with movement of said lower punch, throughout the path of travel of said lower punch and at a lower velocity than said lower punch.

4. A press according to claim 1 and further comprising:

adjustment means for adjusting motion of said die during movement of said lower punch over the path of travel.

5. A press according to claim 4 wherein said adjustment means comprises a worm gear mechanism for adjusting motion of said die during movement of said lower punch over the path of travel.

6. A press according to claim 1 and further comprising:

toggle mechanism means for moving said upper punch toward said die to a closed position to compact particles in said cavity of said die before movement of said lower punch along the path of travel.

7. A press according to claim 6 where in said toggle mechanism means comprises:

a pair of toggle levers, each of said pair of toggle levers being in an extended position when said upper punch is in the closed position.

8. A press according to claim 1 and further comprising:

a pivotable lever;

means for converting movement of said base-plate to pivoting movement of said lever;

means for engaging said lever at a location for converting pivoting movement of said lever into movement of said die; and means for adjusting the location of said lever engaged by said means for engaging for adjusting motion of said die relative to motion of said lower punch.

* * * * *

UNITED STATES PATENT AND TRADEMARK OFFICE

CERTIFICATE OF CORRECTION

PATENT NO. : 5,874,114
DATED : February 23, 1999
INVENTOR(S) : Josef Schrofele

It is certified that error appears in the above-identified patent and that said Letters Patent is hereby corrected as shown below:

Column 1,
Line 52, after "respect" kindly delete the period ".".

Column 3,
Line 3, after "300" kindly delete the period ".".

Column 5,
Line 29, kindly delete "Via" and insert -- via --.
Line 40, after "is" first occurrence, kindly delete the semi-colon ".".

Column 6,
Line 3, after "outward" kindly insert a comma -- , --.

Column 8,
Line 17, kindly delete "where in" and insert -- wherein --.

Signed and Sealed this

Fourth Day of December, 2001

*Attest:*

Nicholas P. Godici

*Attesting Officer*

NICHOLAS P. GODICI
*Acting Director of the United States Patent and Trademark Office*